United States Patent [19]

Dodich

[11] 4,076,314

[45] Feb. 28, 1978

[54] PAVEMENT CUTTING WHEEL MOUNTING FOR EARTH MOVING EQUIPMENT

[75] Inventor: Nicholas Anthony Dodich, Evergreen, Colo.

[73] Assignee: Over-Lowe Company, Inc., Englewood, Colo.

[21] Appl. No.: 729,957

[22] Filed: Oct. 6, 1976

[51] Int. Cl.[2] ..... E01C 23/09

[52] U.S. Cl. ..... 299/40; 172/778

[58] Field of Search ..... 37/DIG. 1; 172/719, 172/778; 299/36, 38, 40; 214/145 R, 145 A; 24/248 R, 248 SA, 248 L, 248 BC, 248 SB; 299/40

[56] References Cited

U.S. PATENT DOCUMENTS

| | | | |
|---|---|---|---|
| 2,036,598 | 4/1936 | Miller et al. | 172/778 |
| 2,821,796 | 2/1958 | Forte | 172/778 |
| 3,136,078 | 6/1964 | Renault | 172/778 |
| 3,261,643 | 7/1966 | Moench | 299/40 |
| 3,355,214 | 11/1967 | McClure | 299/40 |
| 3,472,554 | 10/1967 | Hopkins | 299/40 |

FOREIGN PATENT DOCUMENTS

| | | | |
|---|---|---|---|
| 1,009,774 | 6/1957 | Germany | 24/248 BC |

*Primary Examiner*—Ernest R. Purser
*Assistant Examiner*—William F. Pate, III
*Attorney, Agent, or Firm*—Wm. Griffith Edwards

[57] ABSTRACT

A pavement cutting wheel assembly is arranged to be secured to the earth engaging tool of a motorized earth moving vehicle by a clamping device, and an element of the clamping device is arranged to use the force on the cutting wheel during its cutting operation to increase the clamping effort of the clamping device.

10 Claims, 4 Drawing Figures

PAVEMENT CUTTING WHEEL MOUNTING FOR EARTH MOVING EQUIPMENT

This invention relates to pavement cutting equipment and particularly to an improved device for cutting pavement which may be mounted by clamping it on the working tool such as a bucket or board of a motorized vehicle and including an arrangement for increasing the gripping action of the clamp during operation of the cutting wheel.

Various arrangements have been provided heretofore for utilizing earth working machines such as scrapers, backhoes, front loaders and bulldozers for driving cutting wheels into asphalt pavement and the like for cutting the pavement for removal before digging a required ditch or other hole in streets, highways or other paved areas. It is desirable to provide a separate detachable cutting wheel unit so that an earth moving machine may be used for the cutting operation and that the unit then be removed for regular use of the machine. Various detachable devices have been provided for this purpose and have been satisfactory for many applications. It is desirable to provide a detachable pavement cutting tool unit which may be attached easily and will be maintained by rigid connection with the earth working machine and may be easily attached and detached. Accordingly, it is an object of this invention to provide a detachable pavement cutting device for mounting on an earth working machine including an improved arrangement for holding the device in secure rigid relationship to the machine during use.

It is another object of this invention to provide an improved readily attachable and detachable pavement cutting unit for mounting on the working tool of a motorized earth working machine.

It is a further object of this invention to provide an improved portable, readily detachable pavement cutting wheel unit including an arrangement for clamping the unit to the working tool of an earth working machine and for maintaining the clamping grip more effectively during the operating use of the unit.

Briefly, in carrying out the objects of this invention, in one embodiment thereof a welded plate structure is provided having two arms at the ends of which a pavement cutting wheel is mounted for free rotation. A clamping device is provided for gripping the bottom wall of a bucket, scoop, or board of an earth working machine, a threaded member being provided for effecting the clamping action. The clamping device includes a pivoted member rotatable with respect to the structure and arranged to engage the bucket and upon forward movement of the cutting wheel through pavement, or the like, to urge the clamping device into a tighter gripping engagement with the wall of a bucket or the like.

The features of novelty which characterize this invention are pointed out with particularity in the claims annexed to and forming a part of this specification. The invention itself, however, both as to its organization and its manner of operation, together with further objects and advantages thereof, will best be understood upon reference to the following description taken in connection with the accompanying drawing in which:

FIG. 1 is a perspective view of a cutting wheel assembly embodying the invention mounted on the edge of a loader bucket or the like;

Figure 1:
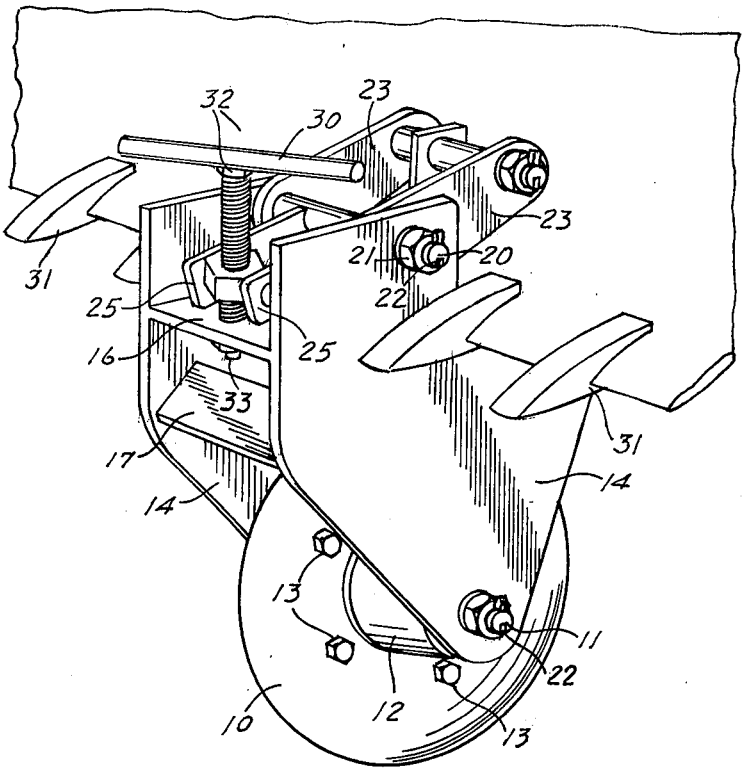
Figure 2:
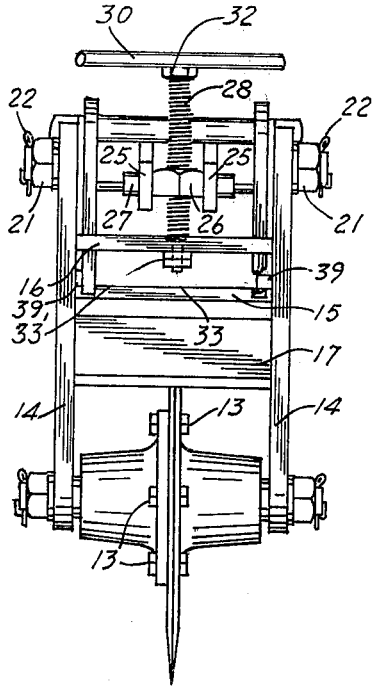
FIG. 2 is a front elevation view of the cutting wheel assembly.
Figure 3:
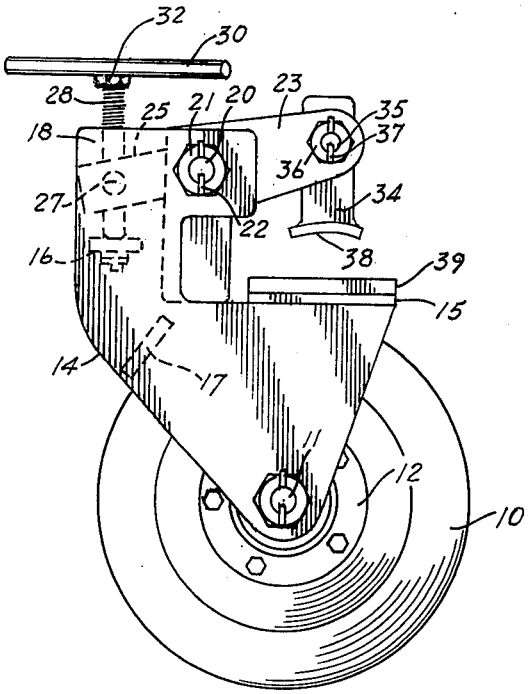
FIG. 3 is a side elevation of the cutter assembly with the clamping mechanism in its open position.

The pavement cutter wheel assembly shown in FIGS. 1, 2 and 3 comprises a cutting wheel 10 mounted on an axle 11 on bearings (not shown) in a hub portion 12 to which the outer cutting portion of disc is secured by bolts 13 so that the cutting portion may be removed and sharpened or replaced. The shaft 11 is securely mounted between a pair of structural support members 14 which are rigidly secured together by cross plates 15, 16 and 17. The side plates 14 as shown are of generally triangular configuration with an upwardly and forwardly extending portion 18 which carries a shaft 20 securely held by nuts 21 locked by cotter keys 22. A member in the configuration of a bell crank comprising two side members 23 rigidly secured together on a cross connecting hollow shaft 24 which is mounted for rotation about the shaft 20 and is provided with rearwardly extending arms 25 between which a nut 26 is rigidly secured for rotation on a shaft 27 which passes through the arms 25. A threaded shaft or bolt 28 having a cross-arm or T-member 30 is welded or otherwise secured to the head 32 of the threaded shaft 28 and provides a handle for turning the shaft. The bottom end of the shaft 28 is rounded and bears against a socket formed in the cross member 16 and is held against removal from the cross member by a threaded portion 33 of reduced diameter which is formed or secured in the bottom of the shaft 28 and is held by lock nuts 33' to allow some relative movement. The connection between the shaft 28 and the fixed cross member 16 allows rotation of the shaft with respect to the plate and sufficient play for movement with changed positions of the bell crank plates 23. The arms 25 are rigidly secured to the bell crank assembly and when the shaft 28 is turned it adjusts the bell crank assembly to selected rotated positions.

As shown in FIG. 3, when the clamping member is opened a blade or bucket of an earth moving vehicle may be inserted between the plate 15 and a pivoted member 34 which is mounted on the bell crank arms 23 on a shaft 55 comprising a threaded bolt secured by a nut 36 and cotter key 27. The pivoted member 34 is provided with a foot or engaging element 38 which provides three point engagement with the blade or bucket, and has been illustrated as a plate or part of triangular configuration with its corners turned down providing the three-point contact with the top surface of the blade or bucket which is placed in clamping position.

Figure 4:
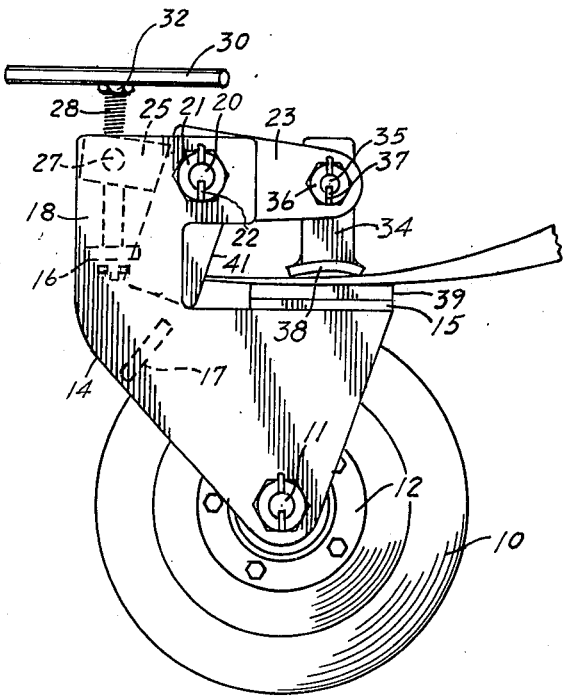
FIG. 4 is a side elevation of the cutting assembly clamped in position on a loader bucket or the like shown in section.

When the unit is in position on the bucket as shown in FIG. 4 the threaded shaft 28 is rotated by the handle 31 until the raising of the arms 25 forces the arms 23 downwardly and presses the foot 38 securely against the bucket or other earth moving tool indicated at 40. A pair of detachable parallel bars 39 are secured to the plate 15 in spaced positions parallel to the plane of the cutting wheel 10. These bars provide space between the bucket surface and the plate 15 and will accommodate raised portions of the bucket surface such as one of the teeth indicated at 31 in FIG. 1; and will provide spaced rests against which the bucket is clamped. These bars may also be shaped to fit the configuration of the bottom surface of the bucket of a backhoe, and because they extend in the direction of movement of the wheel provide seats which lie along and remain in line engagement with the tool surface in the event of any relative movement with respect to the structure. When the unit has been clamped on the bucket in this manner, the edge of the bucket is rested against the lower arm of the bell crank 23 and the edge rests against a sloping portion of the arm indicated at 41. When the clamp is tightened securely the three points of the foot 38 hold the unit tightly on the bucket 40.

During the operation of the cutter, the earth moving machine urges the cutter toward the left as viewed in FIG. 4. The pressure of the cutter as it enters the pavement and moves forward cutting the pavement is directed against the arm 41 and presses it more firmly in a clockwise direction to urge the foot 38 against the bucket 40 thereby increasing the clamping action during cutting movement of the cutter 10. Thus when the greatest strain is on the cutting equipment the clamping mechanism tightens its grip to hold the devices in their fixed relationship more securely than with the clamping action of the handle 31 alone. The result is that the high forces occurring during the cutting operation are resisted by further clamping of the bucket into position to hold the unit rigidly and the possibility of displacement of the unit on the bucket is minimized. The unit is thus held in its original intended position on the bucket or other earth moving tool and in addition the gripping action is increased by increased application of force during the cutting action.

While the invention has been illustrated in connection with a specific arrangement of a pavement cutting wheel unit, various other applications and modifications would occur to those skilled in the art, therefore, it is not desired that the invention be limited to the specific structure illustrated and described and it is intended by the appended claims to cover all modifications which fall within the spirit and the scope of the invention.

I claim:

1. A pavement cutting assembly for attachment to the earth engaging tool of a power driven earth working machine or the like, comprising:

a. a cutter wheel, b. a supporting structure including means for mounting said wheel for free rotation about a horizontal axis, c. means for detachably securing said structure to the earth engaging tool or the like of a power driven earth working machine, d. said securing means including clamping means having portions relatively movable with respect to one another and into engagement with opposite faces of the earth engaging tool for gripping the tool therebetween, and means movable relatively to said structure and positioned for engagement with the tool and tending to move upon forward movement of the tool during the cutting of pavement and to increase the effective gripping force of said clamping means.

2. A pavement cutting assembly for attachment to the earth engaging tool of a power driven earth working machine or the like, comprising:

a. a cutter wheel, b. a supporting structure including means for mounting said wheel for free rotation about a horizontal axis, c. means for detachably securing said structure to the earth engaging tool or the like of a power driven earth working machine, d. said securing means including clamping means for gripping engagement with the opposite faces of the earth engaging tool, and means movable relatively to said structure and positioned for engagement with the tool and tending upon forward movement of the tool during the cutting of pavement to increase the effective gripping force of said clamping means, and said clamping means further including a member pivoted on said structure for rocking movement for urging the face of the tool against said structure, and an arm rigidly secured to said member for engaging the tool and on forward movement of the tool for cutting pavement urging said member forcibly against the tool.

3. A pavement cutting assembly as set forth in claim 2 wherein said clamping means includes a second member pivoted at the end of said first member and having a foot for engagement with the tool.

4. A pavement cutting assembly as set forth in claim 2 wherein said clamping member includes a threaded element threadedly engaging said pivoted member at a position on the opposite side of the pivot from the tool engaging portion thereof and bearing against said structure for applying clamping force to said pivoted member.

5. A pavement cutting assembly as set forth in claim 2 wherein said arm includes a portion positioned for engagement with the forward edge of the tool and having a portion sloping upwardly and rearwardly for increasing the gripping force of said clamping means in the event of upward rocking movement of the front edge of the tool with respect to the structure.

6. A pavement cutting assembly as set forth in claim 3 wherein the foot on said second member is constructed for three point contact with the earth engaging tool.

7. A pavement cutting assembly as set forth in claim 3 including a pair of parallel bars secured to said structure for engaging the bottom face of an earth moving tool for facilitating the clamp action of said clamping means.

8. A pavement cutting assembly as set forth in claim 1 wherein one of said portions is pivoted on said structure and said movable member constitutes a lateral extension on said one portion and is positioned to engage the forward edge of said tool.

9. A pavement cutting assembly as set forth in claim 1 wherein the other of said portions comprises a pair of parallel longitudinal tool engaging members attached to said structure in positions parallel to the plane of said cutter and one on each side of said plane and providing spaced seats for the tool extending in the direction of movement of the cutter during use.

10. A pavement cutting assembly as set forth in claim 2 wherein said clamping means includes a second member rigidly secured to said structure, said second member including a pair of parallel longitudinal tool engaging members attached to said structure in positions parallel to the plane of said cutter and one on each side of said plane and providing spaced seats for the tool extending in the direction of movement of the cutter during use.

* * * * *